United States Patent [19]

Tollefsbol

[11] 3,978,641

[45] Sept. 7, 1976

[54] MACHINE FOR SUPPLYING ARTICLES TO OPEN TOP CONTAINERS

[75] Inventor: Werner L. Tollefsbol, Delran, N.J.

[73] Assignee: Dower, Inc., Delran, N.J.

[22] Filed: June 24, 1975

[21] Appl. No.: 589,685

[52] U.S. Cl. ..... 53/53; 53/59 R; 53/78

[51] Int. Cl.[2] ..... B67B 57/16

[58] Field of Search ..... 53/59 R, 78, 53; 141/153, 129–191

[56] References Cited

UNITED STATES PATENTS 3,837,139 9/1974 Roseberg ..... 53/59 R

*Primary Examiner*—Houston S. Bell, Jr.

*Attorney, Agent, or Firm*—Smith, Harding, Earley & Follmer

[57] ABSTRACT

A machine for supplying articles to open top containers has a conveyor for the conveyance of containers. A horizontal paddle wheel in association with guide members adjacent the conveyor traps each container between adjacent paddles to control the movement of the container adjacent the wheel. A rotatable horizontal disc mounted above the wheel has a plurality of vertical openings through the disc each of which is adapted to receive an article. The articles are retained in the openings by a fixed plate between the disc and the wheel, the fixed plate having a cut away portion over the conveyor to permit the release of the articles from the openings into the containers. A vibratory feeder feeds the articles to a tube which discharges an article into each opening in the disc. Advantageously smooth feeding to the tube is achieved by selection means to reject articles which are not properly aligned for reception by the tube.

7 Claims, 13 Drawing Figures

MACHINE FOR SUPPLYING ARTICLES TO OPEN TOP CONTAINERS

BACKGROUND OF THE INVENTION

Machines for supplying articles to a container on a conveyor are known to the art. Such machines have the conveyor and the supplying means integrally tied together to provide for the necessary timing. The machine of this invention solves the problem of providing an article supplying machine which can be operated with any suitable conveyor and move from one conveyor to another without being integrally tied in with the conveyor to provide the necessary timing.

BRIEF SUMMARY OF THE INVENTION

A machine for supplying articles to open top containers on a conveyor has means including a horizontal wheel adjacent the conveyor having paddles spaced to trap a container between each adjacent pair of paddles to control the movement of the containers adjacent the wheel. A rotatable horizontal disc is mounted above the wheel and has a plurality of vertical openings through the disc each of which is adapted to receive an article. A fixed plate between the disc and the wheel retains the articles in the openings, a portion of the plate over the conveyor being cut away to permit the release of the articles from the openings into the containers. The wheel and the disc are rotated at the same angular rate. Means supply an article to each opening in the disc.

DETAILED DESCRIPTION

Figure 2:
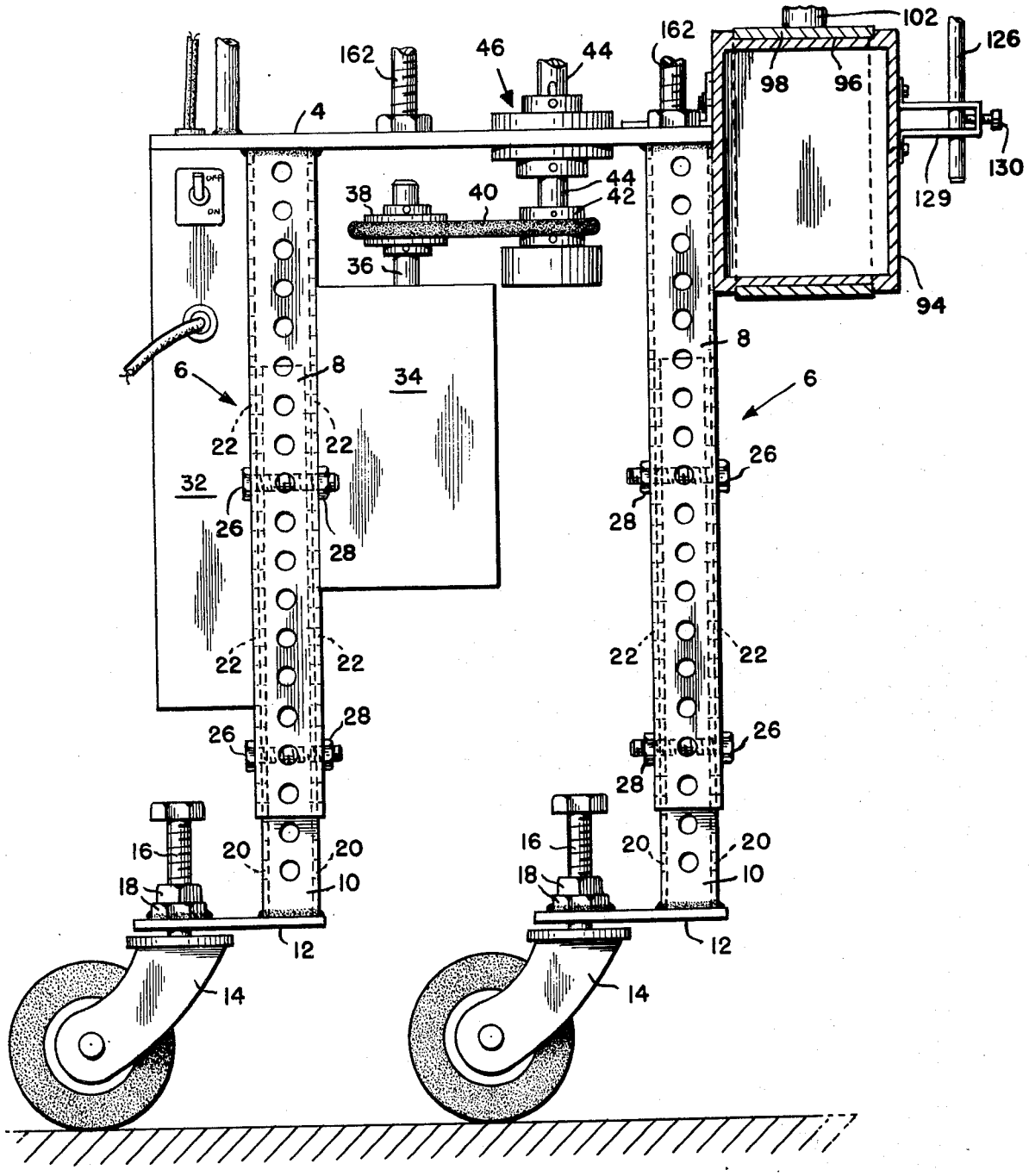
FIG. 2 is a side elevation of the machine of FIG. 1 partially broken away showing the lower portion of the machine.

A machine 2 in accordance with the invention has a base plate 4 supported by adjustable legs 6 each having an upper channel section 8 welded to plate 4 and a lower channel section 10 telescoped within upper section 8 (FIG. 2). Each lower section 10 has a footplate 12 to which is adjustably secured a caster 14 by a bolt 16 secured to the upper portion of caster 14 and passing downwardly through plate 12. Bolt 16 is adjustably secured by a pair of lock nuts 18, 18. The upper leg portion 8 and lower leg portion 10, respectively, have openings 22 and 20 which are adapted to receive bolts 26 in order to adjustably secure together the upper and lower leg sections to provide the legs 6 with the desired length. Bolts 26 are secured by nuts 28.

Figure 1:
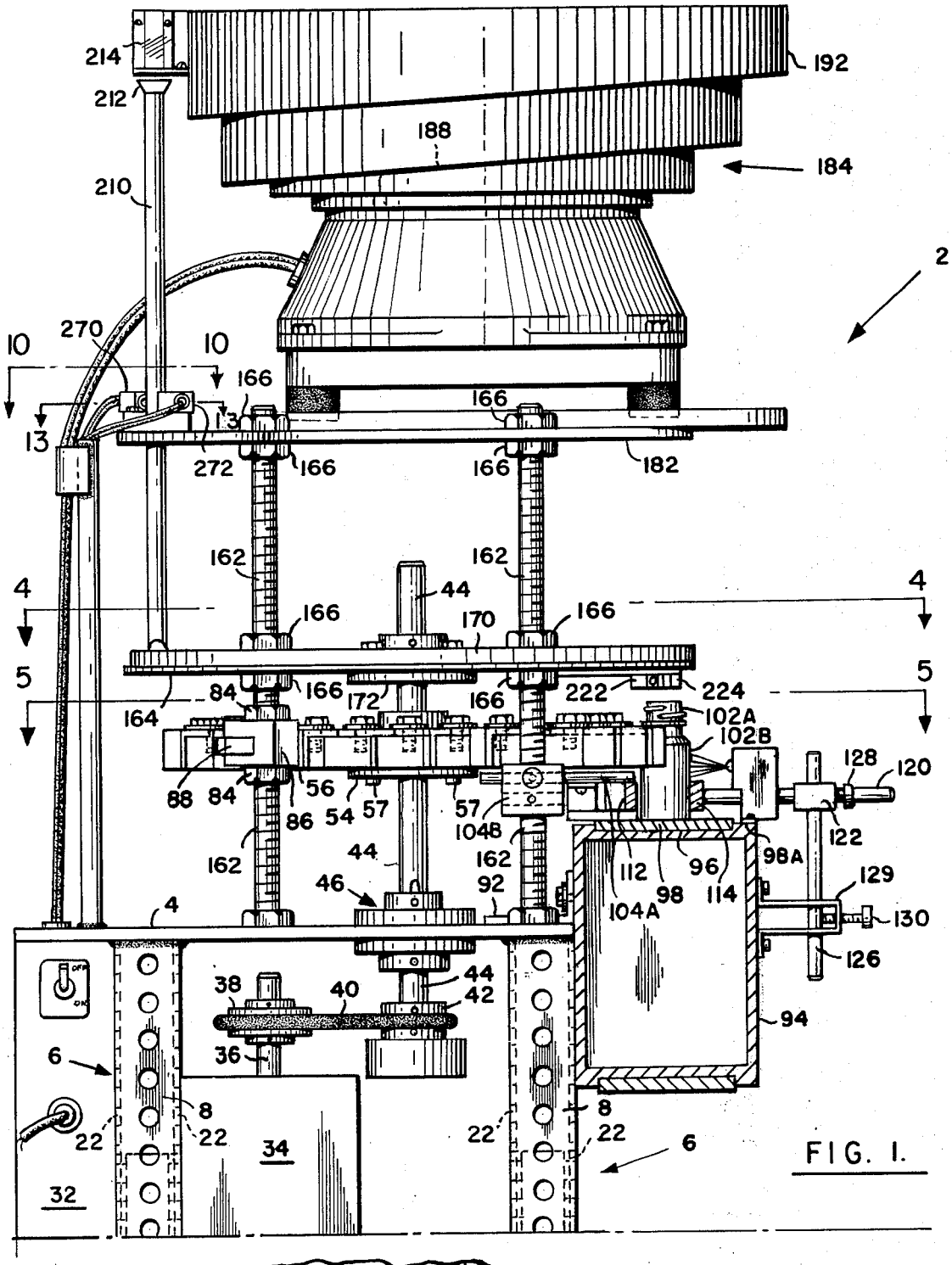
FIG. 1 is a side elevation of an article supplying machine in accordance with the invention with the lower portion of the machine broken away.
Figure 10:
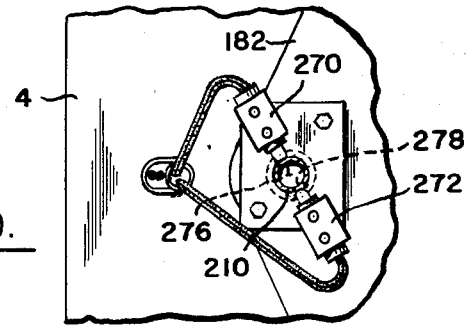
FIG. 10 is a view taken on the plane indicated by the line 10—10 in FIG. 1 and partially broken away.

A switch box 32 and a motor 34 are mounted beneath base plate 4 (FIG. 1). Motor 34 drives shaft 36 which in turn drives a pulley 38 carrying a belt 40 which drives a magnetic clutch 42 connected to shaft 44. Shaft 44 is mounted in a bearing indicated at 46 secured to base plate 4 (FIG. 2).

Figure 5:
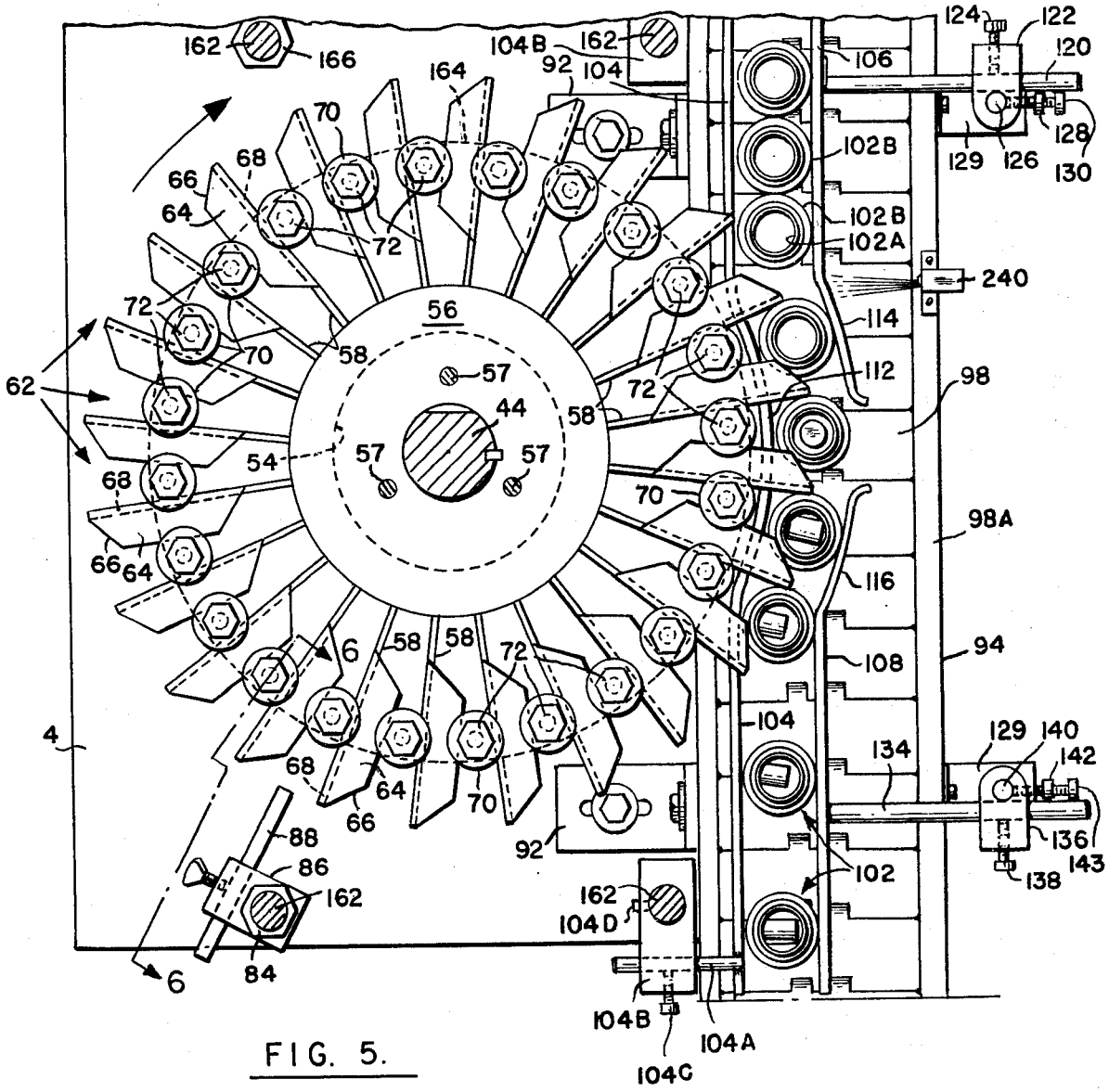
FIG. 5 is a horizontal section taken on the plane indicated by the line 5—5 in FIG. 1.

As best seen in FIG. 1 shaft 44 has a flange 54 secured to a wheel 56 by machine screws indicated at 57. Thus, wheel 56 rotates with shaft 44. Wheel 56 has a series of radial slots 58 (FIG. 5) for the retention of paddle members 62. Each paddle 62 has a substantially horizontal top leg 64 with a chamfered end 66 and a substantially vertical leg 68 which is received in slot 58. A washer 70 retained by a bolt 72 lying between each paddle overlies a pair of adjacent paddles to secure it in the desired position in slots 58.

Figure 6:
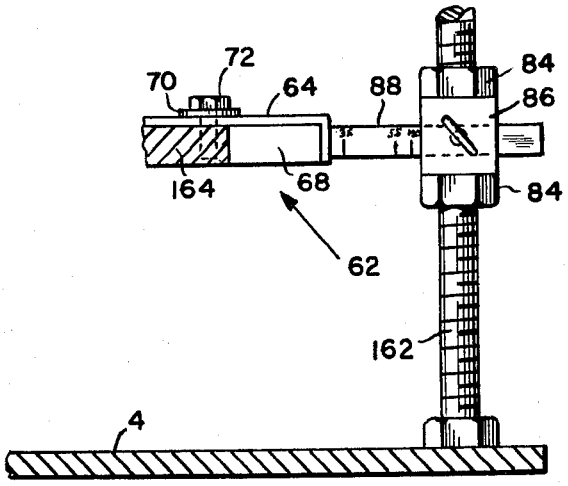
FIG. 6 is a view taken on the plane indicated by the line 6—6 in FIG. 5 showing structure for adjusting the length of the paddles.

A standard 162 is secured to base plate 4 and has mounted thereon by nuts 84, 84 a clamp 86 which adjustably holds a rod 88 (FIG. 6). Rod 88 is used as a convenient means for adjustment of the position of paddles 62 in slots 58. Rod 88 can be marked for adjustment to different lengths to accomodate different size bottles as will be detailed later.

Base plate 4 is secured by a bracket indicated at 92 to a box 94 (FIG. 1) having a recessed portion 96 to carry and guide a conveyor 98 of the conventional type. Bottles 102 are conveyed by conveyor 98 and are guided to a position adjacent paddles 62 by a guide rail 104 (FIG. 5), a guide rail 106 and a guide rail 108. Guide rail 104 has an arcuate portion 112 which parallels the arc of the outer periphery of wheel 56. Guide rail 106 has an arcuate portion 114 opposite arcuate portion 112 and permitting bottles 102 to follow the arcuate portion 112. Guide rail 104 is held by bars 104A each welded to rail 104 and secured to a block 104B by a set screw 104C which in turn is secured to a threaded standard 162 by a set screw 104D. Similarly, guide rail 108 has an arcuate portion 116 opposite arcuate portion 112 which permits the bottles to conform and follow the arcuate portion 112. Guide rail 106 is fixedly secured to a rod 120 adjustably secured in a clamp 122 by set screw 124. Clamp 122 is secured to a rod 126 by a set screw 128. Rod 126 is adjustably secured in a bracket 129 secured to box 94 by a set screw 130 (FIG. 1). Similarly, guide rail 108 is fixedly secured to a rod 134 adjustably secured to a clamp 136 by a set screw 138. Clamp 136 is adjustably secured to a rod 140 by a set screw 142. Rod 140 is adjustably secured by a set screw 143 to a bracket 129 which is fixedly secured to box 94.

Figure 3:
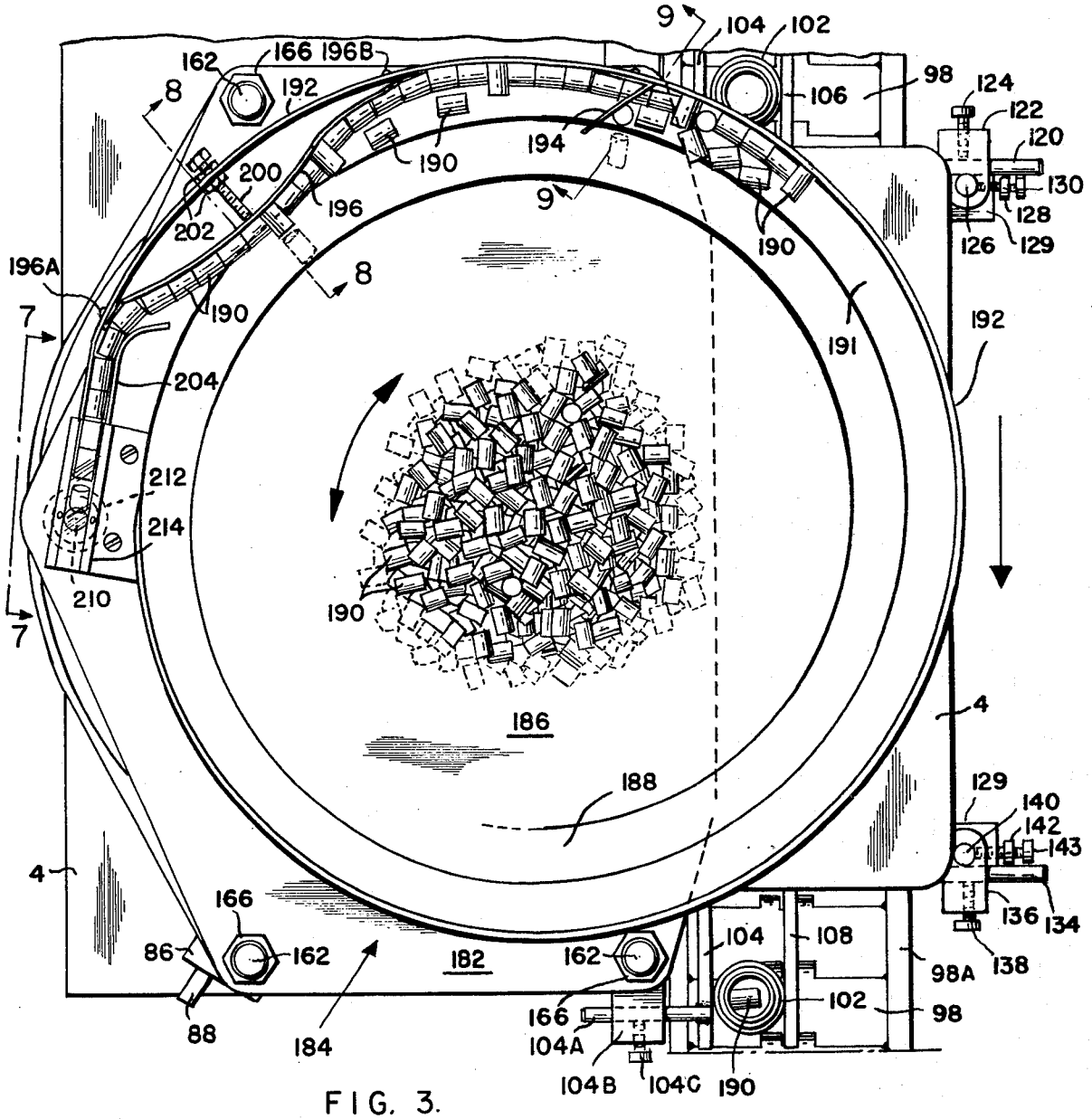
FIG. 3 is a top plan view of the machine of FIG. 1.
Figure 7:
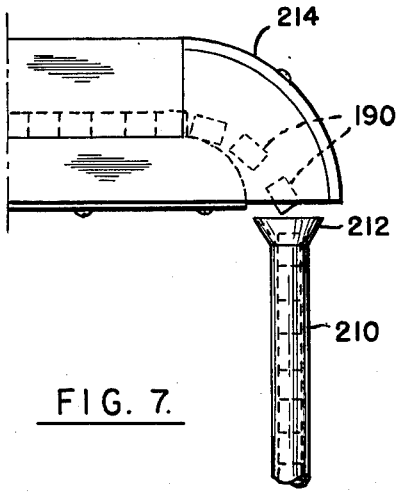
FIG. 7 is a view partially broken away taken on the plane indicated by the line 7—7 in FIG. 3.
Figure 8:
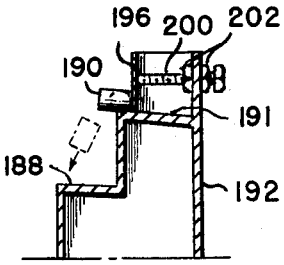
FIG. 8 is a view partially broken away taken on the plane indicated by the line 8—8 in FIG. 3.
Figure 9:
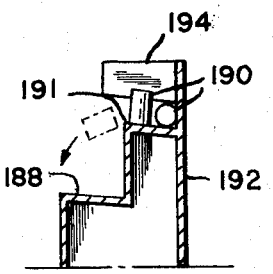
FIG. 9 is a section taken on the plane indicated by the line 9—9 in FIG. 3.
Figure 4:
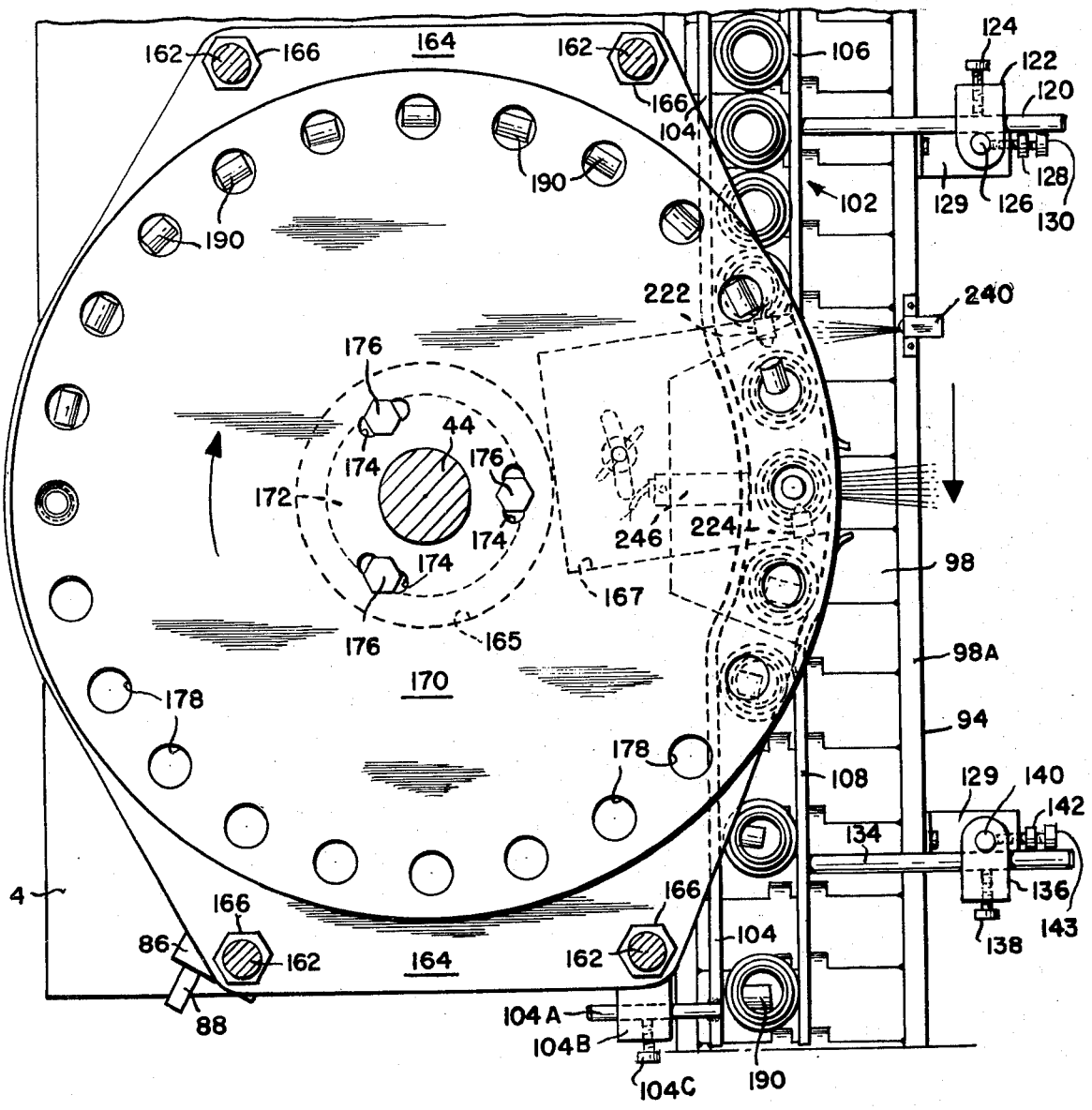
FIG. 4 is a horizontal section taken on the plane indicated by the line 4—4 in FIG. 1.

Four threaded standards 162 (FIG. 1) are fixedly secured to base plate 4 and carry a plate 164 by nuts 166 on the opposite sides of plate 164. Plate 164 having a central opening 165 (FIG. 4) and a cut-out portion 167 closely underlies a disc 170 secured to a flange 172 mounted on shaft 44. As best seen in FIG. 4, disc 170 has a plurality of slots 174 carrying bolts 176 which are bolted to flange 172 to permit an angular adjustment of disc 170 with respect to shaft 44. Disc 170 has a plurality of openings 178 adjacent its periphery Threaded standards 162 also carry a platform 182 (FIG. 1) which is held between nuts 166 on opposite sides of the platform. Mounted on platform 182 is a vibratory feeder 184. As seen in FIG. 3, vibratory feeder 184 has a central reservoir portion 186 and a spiral climbing ramp 188 which conveys the cylindrical article 190 upwardly on the ramp to the upper portion thereof indicated at 191 which is adjacent a wall 192. As thus described the feeder 184 is conventional. It is desired to have the articles 190 in an end for end position adjacent wall 192 and to this end there is provided a barrier 194 under which any article 190 lying down is free to pass but which will engage an upstanding article 190 and cam it off the upper portion 191 of ramp 188. A bypass barrier 196 is connected to wall 192 at 196A and 196B and is arcuate forcing the articles 190 towards the inner edge of the upper ramp portion 191 leaving a width sufficient for the passage of articles which are aligned end for end but causing misaligned articles to be toppled off the ramp. Guide member 196 is flexible and its position is adjustable by virtue of bolt 200 whose position can be adjusted by nuts 202 which secure bolt 200 to wall 192. The articles 190 are then fed between wall 192 and guide rail 204 and pass off the upper portion 191 into a tube 210 which has a funnel entrance 212 (FIG. 7). A plastic cover guard 214 prevents extraneous materials from dropping into funnel 212. As best seen in FIG. 1, tube 210 carries the articles 190 down to the top of disc 170 and an article drops into each opening 178 of disc 170.

Figure 12:
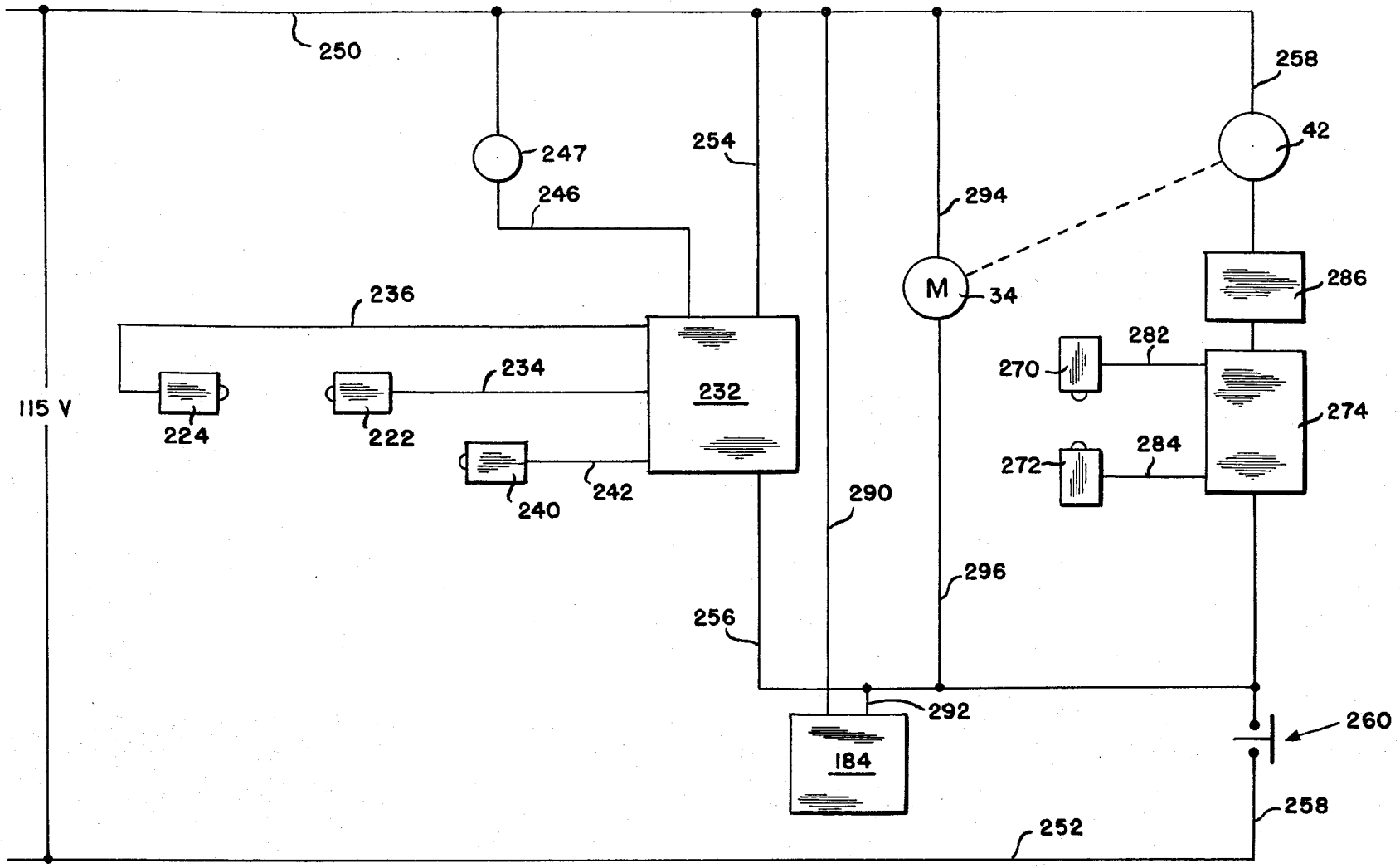
FIG. 12 is a schematic wiring diagram.

The machine 2 includes controls to implement efficient operation. An electric eye 222 and a light source 224 (FIGS. 1, 4 and 12) are mounted below plate 164 so than an article 190 will interrupt the light received by eye 222 as it drops past plate 164 towards a bottle 102. As shown in FIG. 12, eye 222 and light source 224 are a part of sorter 232 and are schematically shown connected thereto by lines 234 and 236, respectively. A reflective photoelectric cell 240 containing its own light source (FIG. 5) is mounted on conveyor frame 98A and directed across the conveyor 98 so as to be actuated by the passage of a bottle 102 to receive the article 190 detected by eye 222. Photoelectric cell 240 is shown schematically connected to sorter 232 by line 242. Sorter 232 is connected across power lines 250 and 252 by line 254 and lines 256 and 258, the latter having a start-stop switch 260. If sorter 232 fails to receive first a signal from eye 240 and then a signal from eye 224, it energizes line 246 and solenoid controlled air jet 247 to blow off either the unfilled bottle 102 or the article 190 for which no bottle was supplied. Photoelectric sorters of the type described here are commercially available, for example, from Scanning Devices Co. of 226 Broadway, Cambridge, Mass. 02139.

Figure 13:
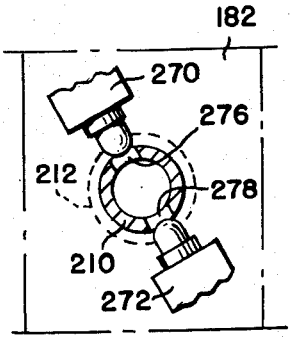
FIG. 13 is a view taken on the plane indicated by the line 13—13 in FIG. 1 and partially broken away.

A photoelectric cell 270 and a light source 272 are placed on opposite sides of openings 276 and 278 in tube 210 to detect articles 190 (FIG. 13). The cell 270 and source 272 are shown schematically connected to an amplifier 274 in line 258 in FIG. 12 by lines 282 and 284, respectively. A time delay device 286 provides a delay of, for example, 5 seconds is in line 258 between amplifier 274 and magnetic clutch 42. If time delay device 286 receives a signal for a predetermined time period indicating that tube 210 is not filled with articles 190 to a level above cell 270, for example 5 seconds, it will open lines 258 and deenergize clutch 42 stopping the drive of machine 2 until it again fails to receive a signal for a predetermined time period, for example 5 seconds, indicating a good supply of articles 190 when it will again energize clutch 42 to start the drive of machine 2.

Feeder 184 is connected to line 250 by line 290 and to line 256 by line 292 and motor 34 is connected to line 250 by line 294 and to line 256 by line 296.

OPERATION

As will be discussed below, the machine 2 is designed to operate with a conveyor which will advance bottles 102 at a substantially greater linear rate than the bottles are advanced by the paddles 62. To start up machine 2, the vibrator feeder 184 is loaded with articles 190 and the switch 260 is turned on causing articles 190 to climb ramp 188 and align themselves end for end between guides 204 and 206 and drop off into tube 210 to fill up tube 210. As detailed above the end for end relationship of articles 190 is achieved by camming off the upper portion of 191 of platform 188 the articles 190 which are standing up by barrier 194 and causing the misaligned articles 190 which are lying down to be toppled off by virtue of rail 196. Motor 34 is causing the rotation of paddles 62 and disc 170. As disc 170 rotates an article 190 drops in each opening 178 in disc 170 and is held in said opening by virtue of fixed plate 164 which lies below openings 178. In the meantime bottles 102 on conveyor 98 are being engaged with one bottle between each pair of paddles 62. The leading portion of the neck 102A of each bottle 102 engages the chamfered portion 66 of one paddle 62, while the trailing edge of the body portion 102B of the bottle 102 is engaged by the leg 68 of the next adjacent paddle 62. With the bottle thus confined between two paddles it is moved about the arc defined by guide rail 112 at the same angular rate as shaft 44 is turning. Disc 170 being secured to shaft 44 is moving at the same angular rate and is secured to shaft 44 so that the nearest opening 178 to the bottle in question will be positioned directly over the bottle opening at this juncture, that is to say the opening 178 in disc 170 and the opening in the adjacent bottle 102 will be in registry during this period of travel. The cut-out portion 167 in plate 164 lying below disc 170 permits the article 190 to drop out of opening 170 during this portion of the travel of the paddles 62 and bottle 102 together resulting in the article 190 dropping into the bottle. Bottle 102 is then released from its position between the paddles and continues to travel between guide rail 108, guide rail 112 and thence on the conveyor to a discharge point (not shown).

Figure 11:
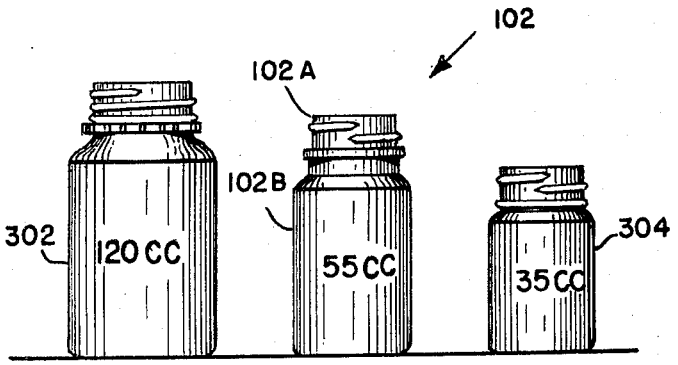
FIG. 11 is a side elevation of a plurality of bottles adapted to be employed with the machine of the invention.

The apparatus is adjustable to accomodate a range of bottle sizes. For example, if a bottle 302 (FIG. 11) larger in size than the bottle 102 is to be used, rails 106 and 108 will be moved outwardly to provide sufficient width for the larger bottle and conversely for a smaller bottle 304 rails 106 and 108 would be moved inwardly. Further, to accomodate the larger bottle, paddles 62 are moved inwardly in slots 58 sufficiently so as to properly engage the leading and rear portions of the larger bottle and move it through the area adjacent the arcuate portion 112 of guide rail 104. The adjustment of the paddle 62 is accomplished by loosening nut 72 before moving the paddles and retightening the nuts thereafter. If the bottle size is properly coded on rod 88, rod 88 is adjusted to the correct position for such a bottle and each paddle 62 is adjusted by moving it in slot 58 to a position where the outer edge of leg 68 will touch the end of rod 88.

The above described embodiment is illustrative and is not intended to be limiting.

I claim:

1. A machine for supplying articles to open top containers on a moving conveyor comprising:

means including a horizontal wheel adjacent the conveyor having paddles spaced to trap a container between each adjacent pair of paddles to control the movement of the containers adjacent said wheel, a rotatable horizontal disc mounted above said wheel and having a plurality of vertical openings through the disc each for the reception of an article, a fixed plate between the disc and the wheel to retain the articles in said openings, a portion of the plate over the conveyor being cut away to permit the release of the articles from the said openings into the containers, means to rotate the wheel and the disc at the same angular rate, and means to supply an article to each opening in the disc.

2. The machine of claim 1 in which the means to control the movement of the containers includes guide rails adjacent the conveyor to cause the containers adjacent the wheel to move on an arcuate path.

3. The machine of claim 1 adapted to supply elongated cylindrical articles to the containers with the axis of the article substantially vertical which has means to supply a cylindrical article to each opening with the axis of the cylinder substantially vertical.

4. The machine of claim 3 in which the means to supply an article to each opening comprises a substantially vertical tube, a ramp for the delivery of the articles to the tube, means to advance the articles along the ramp, means to cam off the ramp articles not aligned end for end.

5. The machine of claim 4 in which the means to cam off the ramp articles not aligned end for end includes a barrier to remove from the ramp upstanding articles and an arcuate barrier which urges the articles to a position adjacent an edge of the ramp and only permits the passage of articles aligned end for end past the barrier.

6. A machine in accordance with claim 1 having means to stop the rotation of the wheel and the disc when the means to supply an article to each opening in the disc has an insufficient number of articles to carry out its function.

7. A machine in accordance with claim 1 having means to detect the presence of a container to receive an article and the delivery of an article to said container and to direct a blast of air at the conveyor at the point of delivery of the article to the container to remove the container or the article from the conveyor if one of them is detected as being absent.

* * * * *